US005316211A

United States Patent [19]

Chang

[11] Patent Number: 5,316,211

[45] Date of Patent: May 31, 1994

[54] HAND CARRYING CASE

[76] Inventor: Chung-Cheng Chang, No. 346, Ingtsair Rd., North District, Taichung City, Taiwan

[21] Appl. No.: 43,739

[22] Filed: Apr. 7, 1993

[51] Int. Cl.[5] ..... B65D 5/48; B65D 85/28

[52] U.S. Cl. ..... 229/120.21; 206/214; 206/443; 206/576

[58] Field of Search ..... 229/120.21, 40; 206/214, 215, 223, 224, 443, 476, 486, 487, 576

[56] References Cited

U.S. PATENT DOCUMENTS

| | | | |
|---|---|---|---|
| Re. 12,112 | 5/1903 | Trescott | 206/224 |
| 265,625 | 10/1882 | Oakes | 206/215 |
| 2,414,720 | 1/1947 | Cohen | 206/215 |
| 3,368,735 | 2/1968 | Levi | 229/40 |
| 3,664,572 | 5/1972 | Puchkoff et al. | 229/40 |
| 3,966,113 | 6/1976 | Tipton | 229/40 |
| 4,111,299 | 9/1978 | Taub | 229/120.21 |
| 4,645,077 | 2/1987 | McLaughlin et al. | 206/215 |

FOREIGN PATENT DOCUMENTS

| | | | |
|---|---|---|---|
| 56694 | 7/1912 | Austria | 206/214 |
| 1008250 | 5/1952 | France | 206/214 |

*Primary Examiner*—Gary E. Elkins

*Attorney, Agent, or Firm*—Morton J. Rosenberg; David I. Klein

[57] ABSTRACT

Disclosed is a hand carrying case made by folding up a unitary base sheet, comprising a back panel connected between a front panel and a cover flap by a bottom panel and a top panel and connected between two reinforcing side strips by two side panels, a partition flap connected to the front panel by two spaced connecting strips, the front panel having side projections inserted through holes between the side panels and the reinforcing side strips and fitted into recessed portions on the front panel, one connecting strip having holes for inserting pens into the compartment defined between the partition flap and the front panel.

1 Claim, 5 Drawing Sheets

HAND CARRYING CASE

BACKGROUND OF THE INVENTION

The present invention relates to a hand carrying case for carrying a variety of things with the hand which is made by folding up a unitary base sheet.

A variety of hand carrying cases may be used for carrying loose papers, pamphlets, magazines, writing devices, etc. These hand carrying cases are commonly comprised of a variety of panels defining different compartments for keeping different items. The panels are separately made, and then fastened together by stitches, adhesive agents, or fastening devices. Because the manufacturing process is complicated, the cost of the conventional carrying cases is expensive.

SUMMARY OF THE INVENTION

One object of the present invention is to provide a hand carrying case which is made by folding up an integral base sheet without the use of any fastening devices or hand tools so that the manufacturing cost is be greatly reduced. Another object of the present invention is to provide a hand carrying case which has a variety of compartments for keeping a variety of items.

DETAILED DESCRIPTION OF THE PREFERRED EMBODIMENT

Figures 1, 1A:
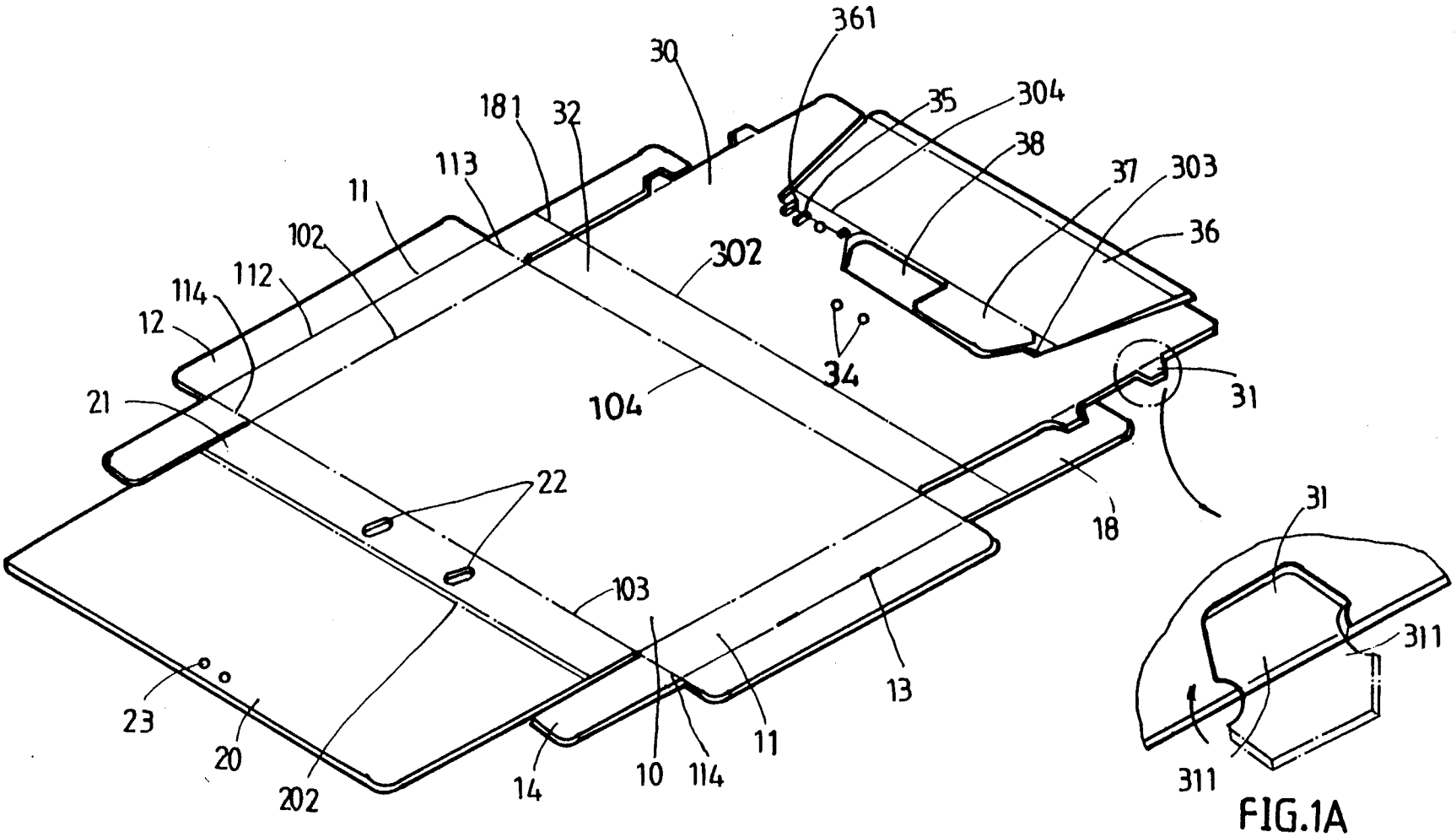
FIG. 1 is a spread-out view of a hand carrying case made according to the present invention.
Fig. 1A is a partial enlarged view of the back panel showing the side projection folded down and fitted into the respective recessed portion.

Referring to FIG. 1, a hand carrying case according to the present invention is made by folding up a base sheet into shape, which is generally comprised of a back panel 10, a cover flap 20, and a front panel 30.

The back panel 10 is made in a rectangular shape, having two longer sides respectively connected to the cover flap 20 and the front panel 30, and two reinforcing strips 12 connected to the two opposite shorter sides thereof by side panels 11. The reinforcing strip 12 is connected to either side panel 11 by a folding line 112; the side panel 11 is connected to either shorter side of the back panel 10 by a folding line 102. Two narrow, elongated plug holes 13 are aligned on the folding line 112 between the reinforcing strip 12 and the side panel 11 at either shorter side of the back panel 10, which receive the respective side projections 31 on either shorter side of the front panel 30. Two upper parting strips 14 are respectively extended from the side panels 11 in the longitudinal direction and spaced along the two opposite shorter sides of the cover flap 20. Two lower parting strips 18 are respectively extended from the side panels 11 in the longitudinal direction and spaced along the two opposite shorter sides of the back panel 30.

The cover flap 20 is also made in a rectangular shape having a longer side connected to the back panel 10 by a top panel 21. The cover flap 20 further comprises two wire holes 23 spaced near the opposite longer side in the middle for inserting a wire. The top panel 21 is connected to the cover flap 20 by a folding line 202, and connected to the back panel 10 by a folding line 103. The folding line 103 has two opposite ends terminated to two folding lines 114, which separate the upper parting strips 14 and the side panels 11 respectively. The top panel 21 has two oval holes 22 for fastening a carrying handle.

The front panel 30 has a longer side connected to the back panel 10 by a bottom panel 32. The bottom panel 32 is connected to the back panel 10 by a folding line 104, and connected to the front panel 30 by a folding line 302. The folding line 104 has two opposite ends terminated to two folding lines 113, which separate the side panels 11 and the lower parting strips 18 respectively. The folding line 302 is longitudinally aligned with two folding lines 181 through the lower parting strips 18. The front panel 30 comprises two pairs of side projections 31 spaced on two opposite shorter sides thereof, which are respectively inserted into the plug holes 13. Recessed portions 311 are made on the front panel 30 opposing the side projections 31. When folded up, the side projections 31 are respectively inserted through the respective plug holes 13 and then fitted into the recessed portions 311. A trapezoidal partition flap 36 is formed by cutting the opposite longer side of the front panel 30. The trapezoidal partition flap 36 is connected to the front panel 30 by a first connecting strip 361 and a second connecting strip 37. The connecting strips 361;37 are spaced by a projecting strip 38 on the front panel 30. The projecting strip 38 serves as a cover flap covered on the space defined between the front panel 30 and the partition flap 36 as the base sheet is folded up into shape. The connecting strips 361;37 are respectively connected to the partition flap 36 and the front panel 30 by folding lines 303;304. The first connecting strip 361 has round holes 35 for inserting pens.

Figure 2:
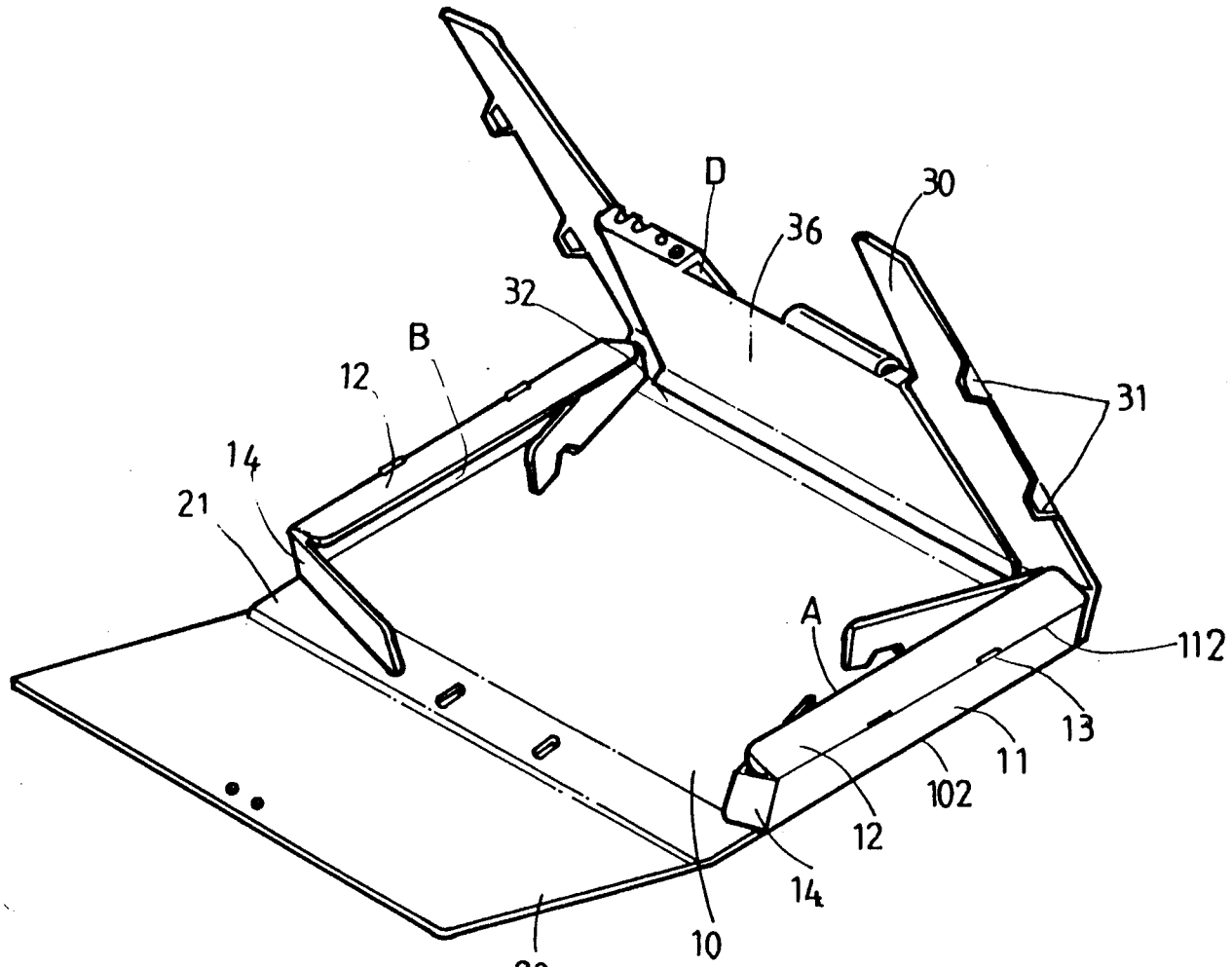
FIGS. 2 and 3 illustrate the procedure to fold up the base sheet into the hand carrying case.
Figure 3:
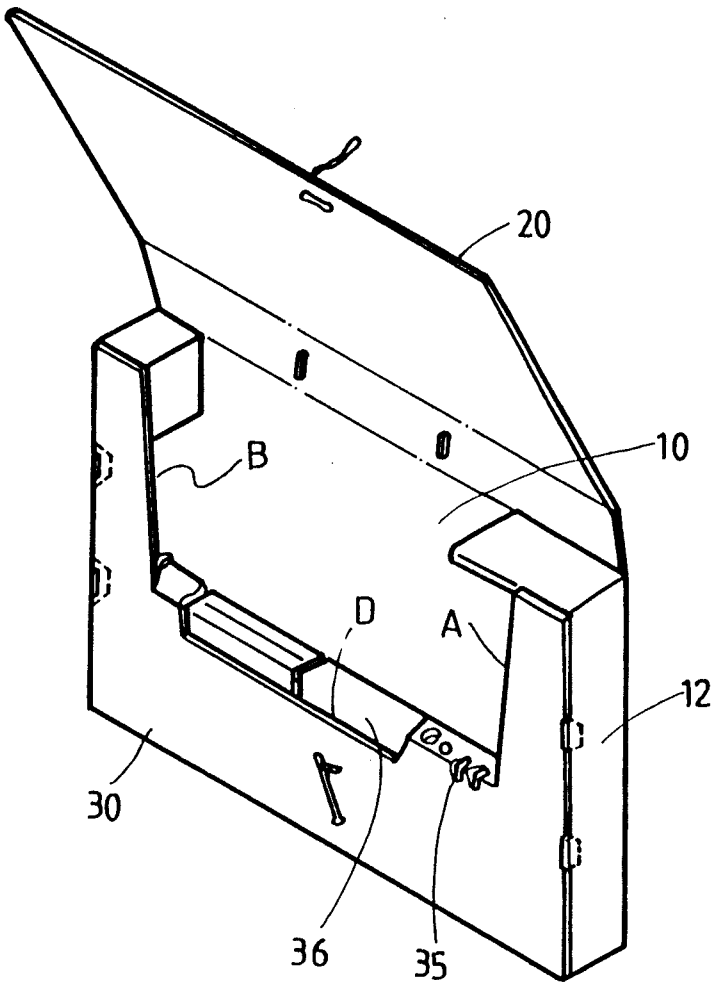
Figure 4:
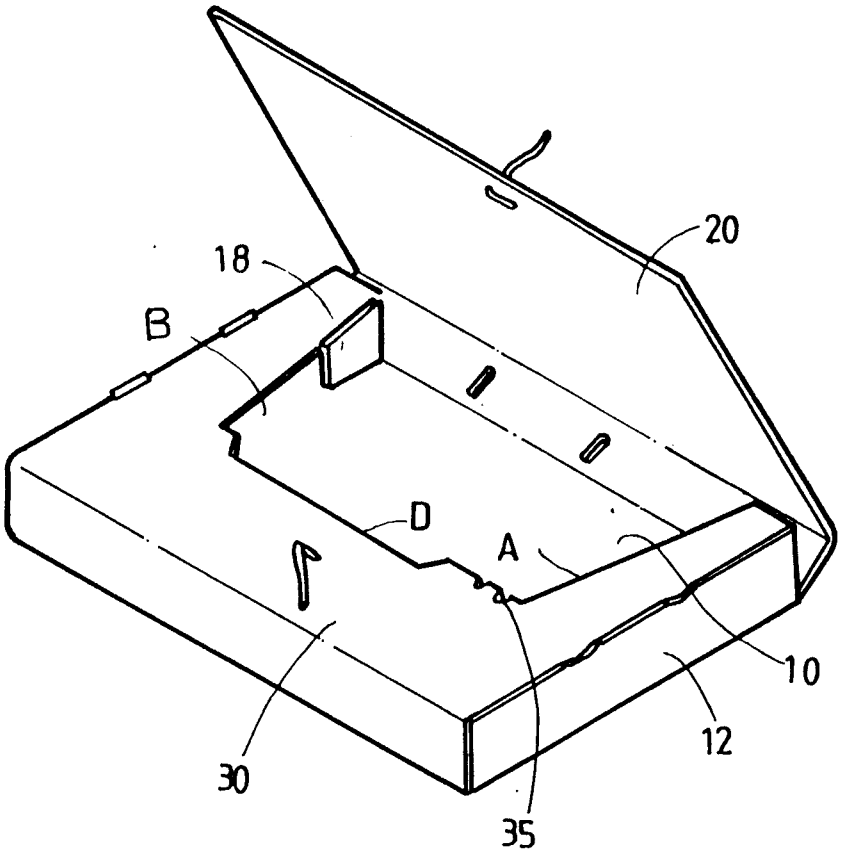
FIG. 4 is a perspective elevational view of the hand carrying case.
Figure 5:
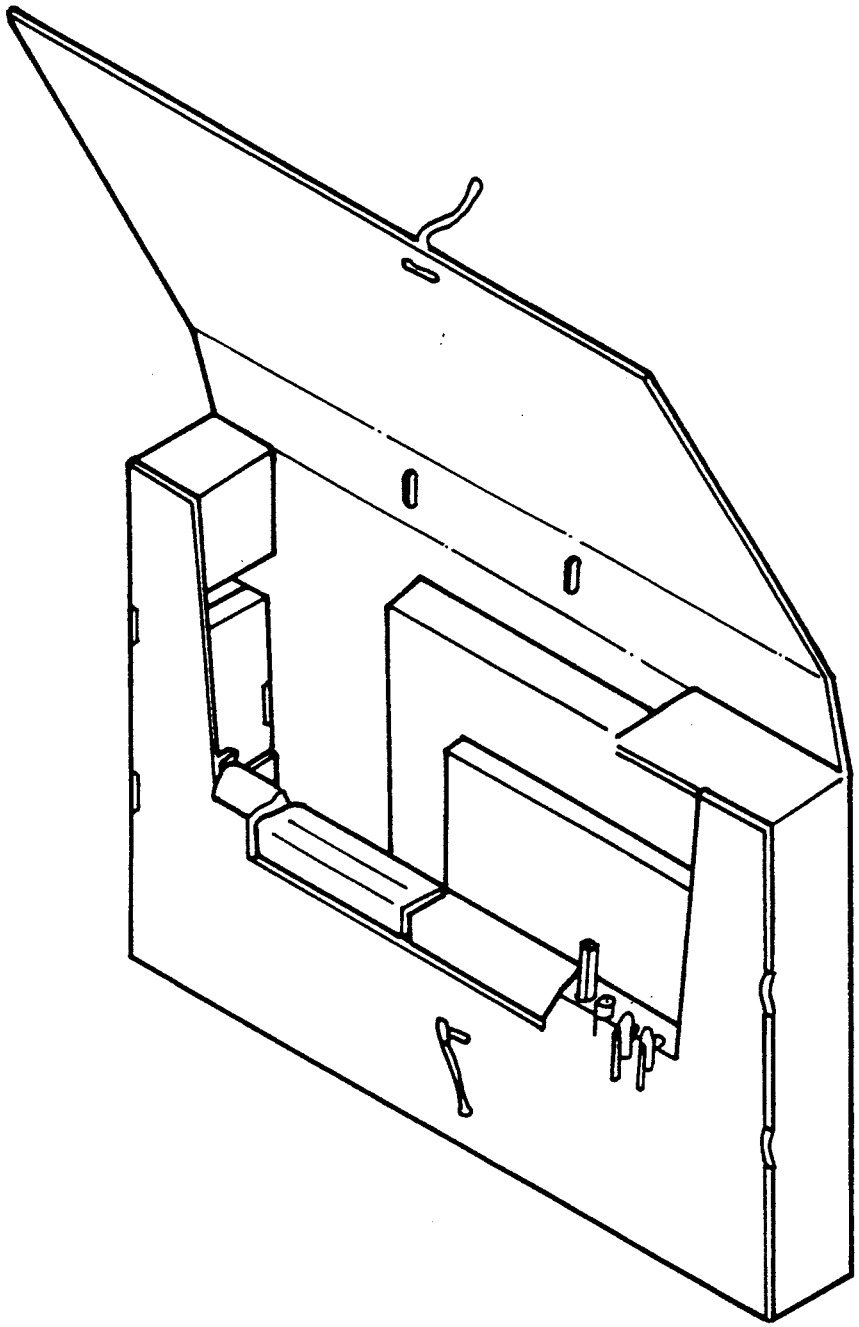
FIG. 5 is an applied view showing a variety of things held in the hand carrying case.

Referring to FIGS. 2 and 3, the side panels 11 and the reinforcing strips 12 are respectively folded back along the respective folding lines 102;112, and then the upper and lower parting strips 14;18 are respectively folded back along the respective folding lines 114;113;181. Therefore, two compartments A;B are respectively defined within the back panel 10, the side panels 11, the reinforcing strips 12, the upper parting strips 14, and the lower parting strips 18 for storing pencil cases, crayon cases, etc. The partition flap 36 and the connecting strips 361;37 are respectively folded back along the respective folding lines 303;304. Therefore, a compartment D is defined between the partition flap 36 and the front panel 30. By opening the projecting strip 38, an opening (not shown) is formed for putting things into the compartment D. Pens or other elongated writing items can then be inserted through the round holes 35 into the compartment D. The front panel 30 and the bottom panel 32 are then folded back along the respective folding lines 02;104, and then the side projections 31 are respectively inserted through the plug holes 13 and fitted into the recessed portions 311. Then, the cover flap 20 and the top panel 21 are respectively folded back along the respective folding lines 114;202. After the base sheet has been folded up into shape, a wire may be inserted through the wire holes 34 on the front panel 30 and then inserted through the wire holes 23 on the cover flap 20 to tie up the cover flap 20 to tie the cover flap 20 to the front panel 30. A handle may be fastened to the oval holes 22 on the top panel 21 for carrying with the hand.

As indicated, the present invention provides a hand carrying case made by folding up a base sheet without the use of any external fastening device or hand tools, which has different compartments for keeping loose papers, pamphlets, pencil cases, pens, and any of a variety of writing items.

What is claimed is:

1. A hand carrying case made by folding up a unitary base sheet, comprising a front panel, a cover flap, two side panels, two reinforcing side strips, two upper parting strips, two lower parting strips, a partition flap, and a back panel, said back panel having one longer side connected to said front panel by a bottom panel, an opposite longer side connected to said cover flap by a top panel, two opposite shorter sides respectively connected to said reinforcing side strips by said side panels, said upper and lower parting strips being respectively and longitudinally extended from said side panels at two opposite ends, said partition flap being connected to said front panel by a first connecting strip and a second connecting strip, said first and second connecting strips being separated by a projecting strip on said front panel, said front panel having side projections respectively inserted through holes between said side panels and said reinforcing side strips and then respectively fitted into respective recessed portions on said front panel, said first connecting strip having round holes for inserting, said cover flap and said front panels having wire holes for inserting a wire to tie said cover flap to said front panel, said top panel having holes for mounting a carrying handle, said partition flap being folded back to define a compartment between said front panel, said side panels, said reinforcing side strips, and said upper and lower parting strips flap being respectively folded back to define two separate compartments with said back panel.

* * * * *